US006021937A

United States Patent [19]

Schryver et al.

[11] Patent Number: 6,021,937

[45] Date of Patent: Feb. 8, 2000

[54] SKI EQUIPMENT CARRIER

[76] Inventors: Robert R. Schryver, 37143 Waverly Ter., Apt. 131, Fremont, Calif. 94536; Marcia Mitchell, 75 Las Casas, San Rafael, Calif. 94901

[21] Appl. No.: 09/167,517

[22] Filed: Oct. 6, 1998

[51] Int. Cl.[7] ..... A45F 3/02

[52] U.S. Cl. ..... 224/610; 224/578; 224/611; 224/660; 224/663; 224/664; 224/917

[58] Field of Search ..... 224/578, 579, 224/580, 586, 607, 660, 663, 676, 680, 917, 610, 611, 664

[56] References Cited

U.S. PATENT DOCUMENTS

| | | | |
|---|---|---|---|
| D. 366,562 | 1/1996 | Sung-Rok . | |
| 3,912,141 | 10/1975 | Appel | 150/108 |
| 3,960,302 | 6/1976 | Mazzoni . | |
| 4,131,289 | 12/1978 | Maller . | |
| 4,308,982 | 1/1982 | Hall . | |
| 4,458,935 | 7/1984 | Fields, Jr. . | |
| 4,518,107 | 5/1985 | Amos | 224/586 |
| 4,673,118 | 6/1987 | Kronz . | |
| 4,746,159 | 5/1988 | Webb et al. | 294/147 |
| 4,792,073 | 12/1988 | Jacober | 224/614 |
| 5,450,991 | 9/1995 | Neading | 224/578 |
| 5,464,138 | 11/1995 | Rodriguez . | |
| 5,762,242 | 6/1998 | Yost . | |

FOREIGN PATENT DOCUMENTS

| | | | |
|---|---|---|---|
| 2278289 | 2/1976 | France | 224/917 |
| 0127556 | 5/1984 | France | 224/917 |
| 0612489A1 | 8/1994 | France | 224/917 |
| 2655151 | 6/1978 | Germany | 224/917 |
| 2280096A | 7/1994 | United Kingdom | 224/917 |

*Primary Examiner*—Gregory M. Vidovich
*Assistant Examiner*—Maerena W. Brevard
*Attorney, Agent, or Firm*—Karl Bozicevic; Bozicevic, Field & Francis LLP

[57] ABSTRACT

A device for carrying equipment, such as a pair of snow skis and other ski equipment, is provided. The device comprises a container, a means for holding the skis attached to the outside surface of the container, and a carrying belt attached to the container. The device permits skis to be conveniently transported in a sling-like fashion. In addition, other supplies can be transported within the container, or secured to the outside of the container.

18 Claims, 7 Drawing Sheets

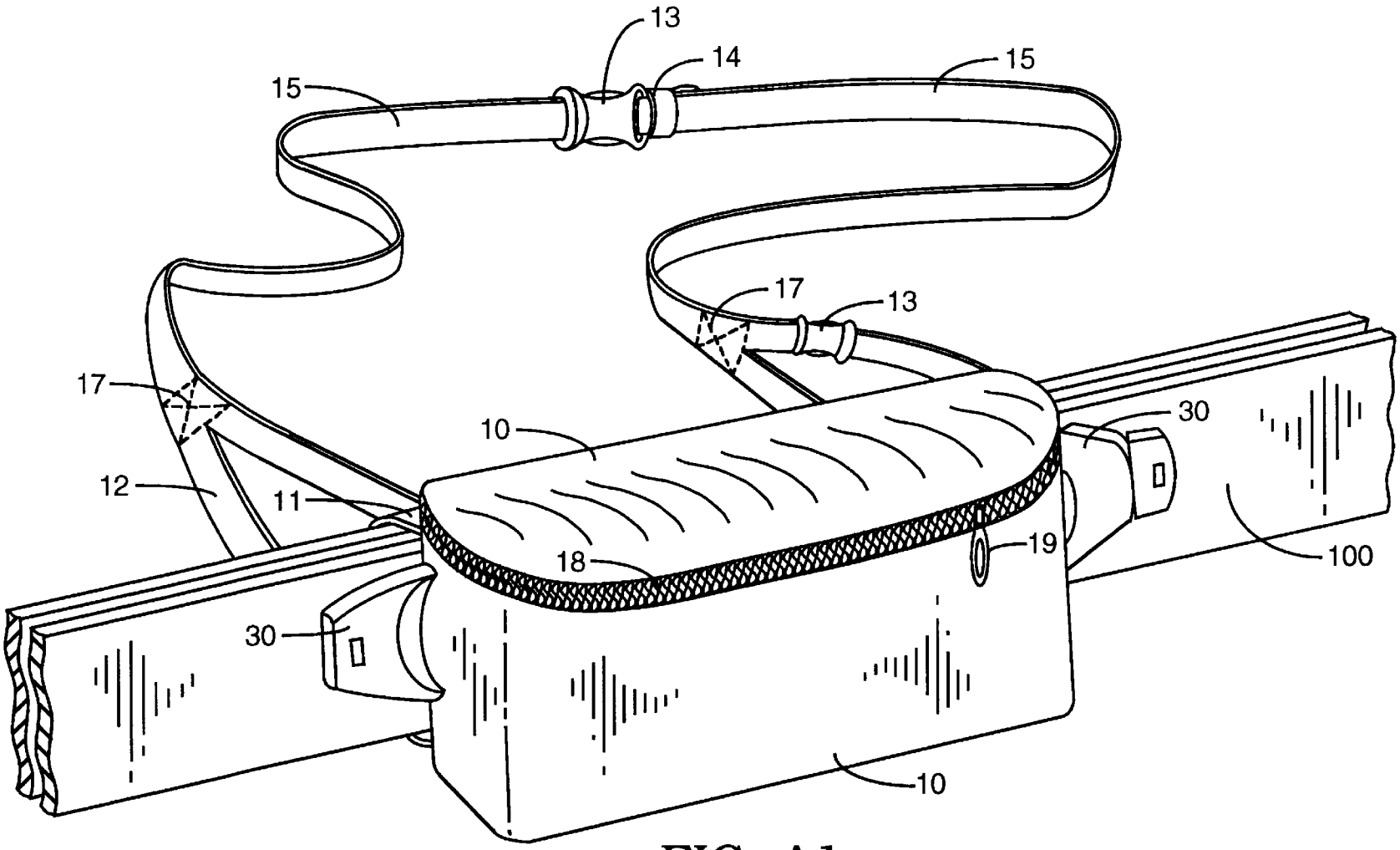
FIG. A1

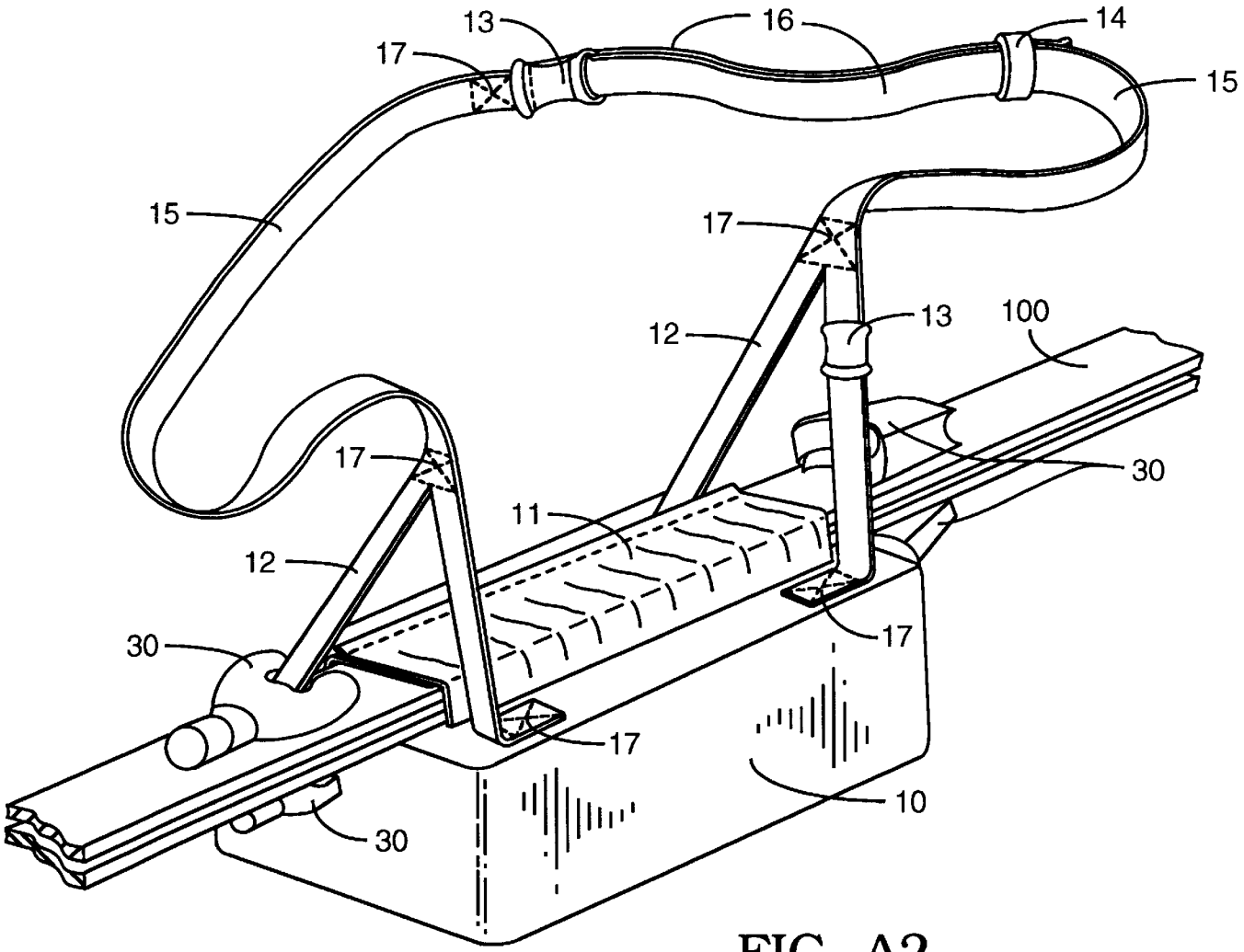
FIG. A2

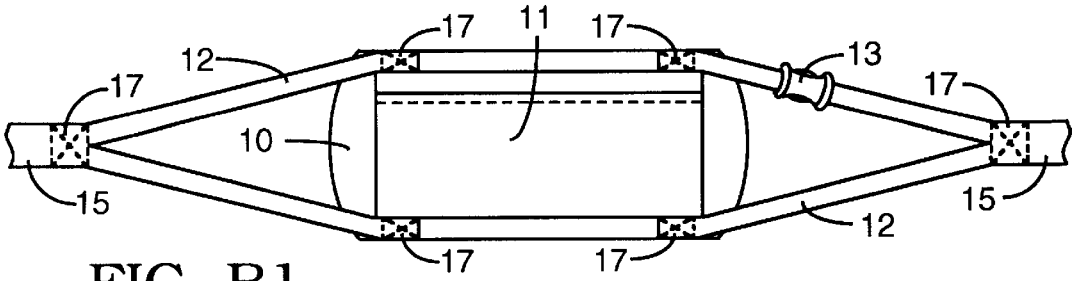
FIG. B1
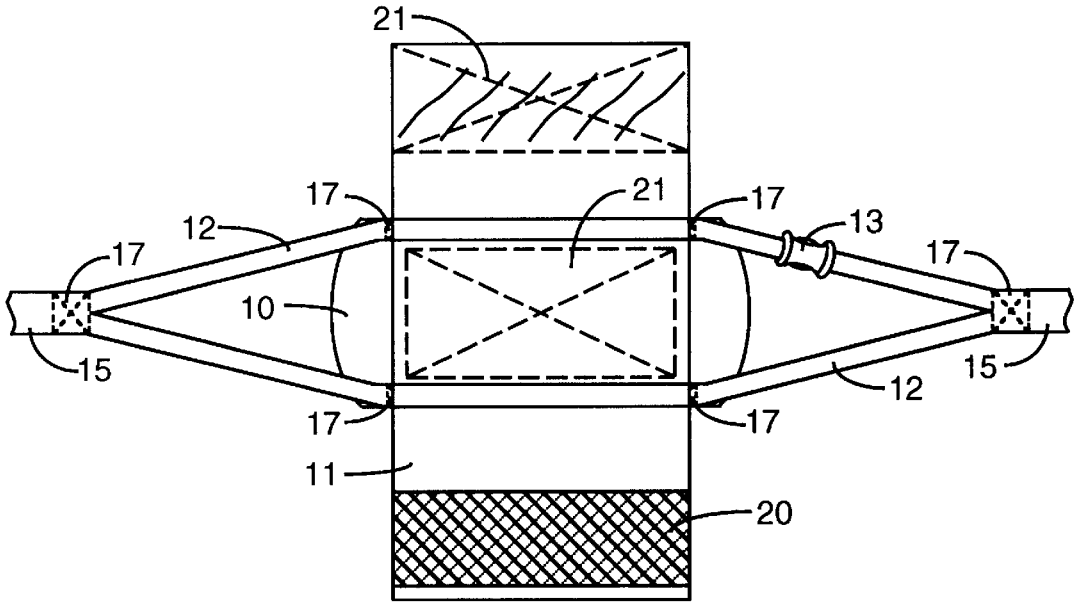
FIG. B2

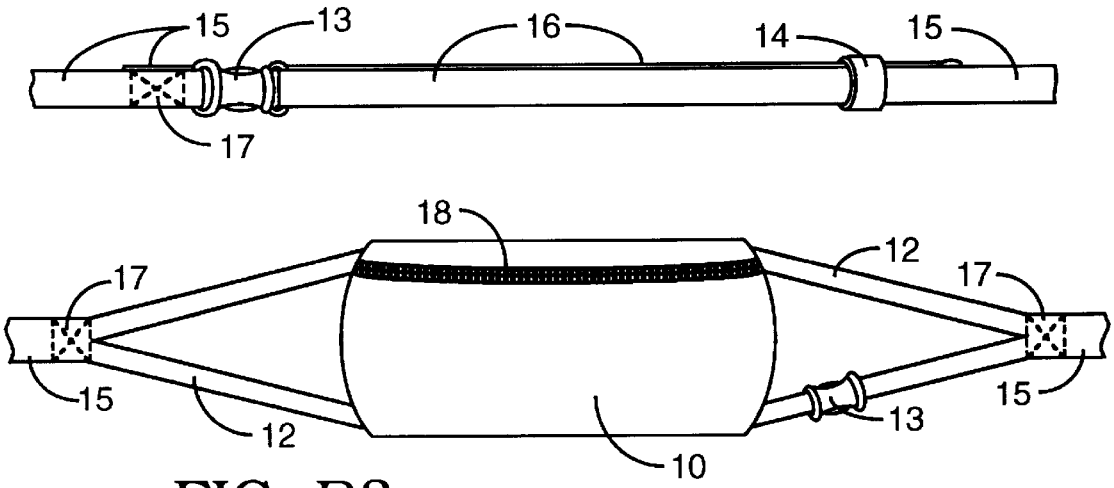
FIG. B3
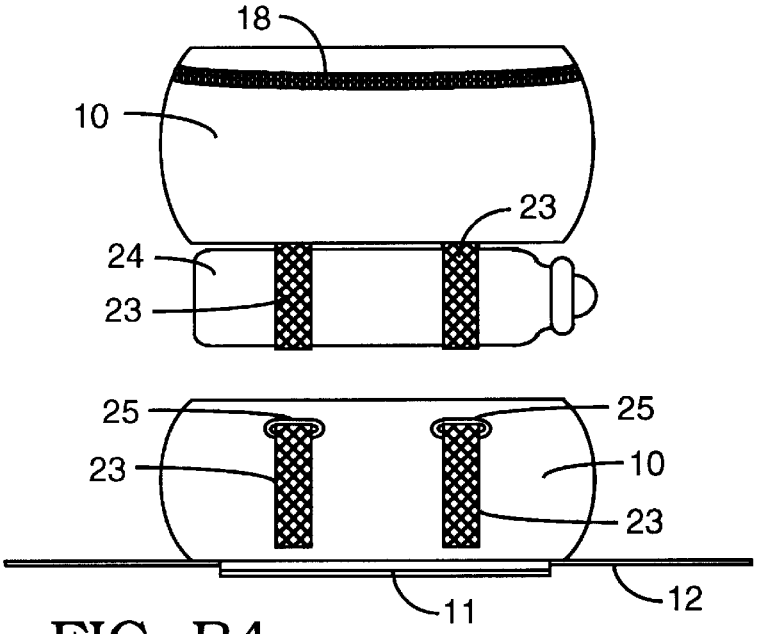
FIG. B4

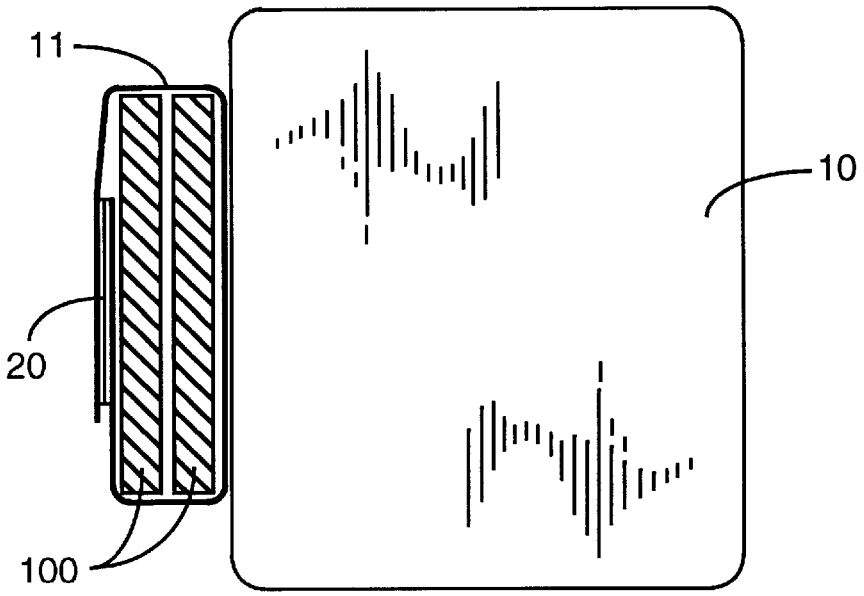
FIG. B5
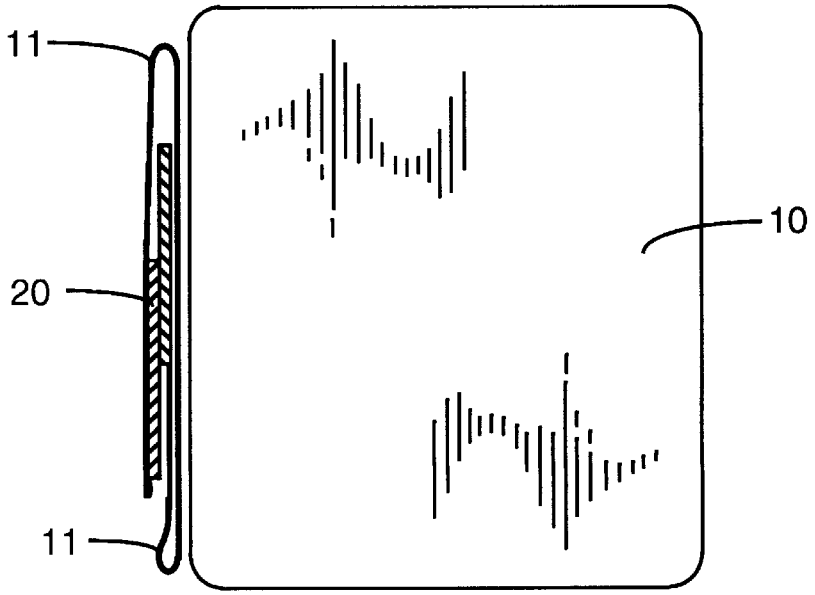
FIG. B6

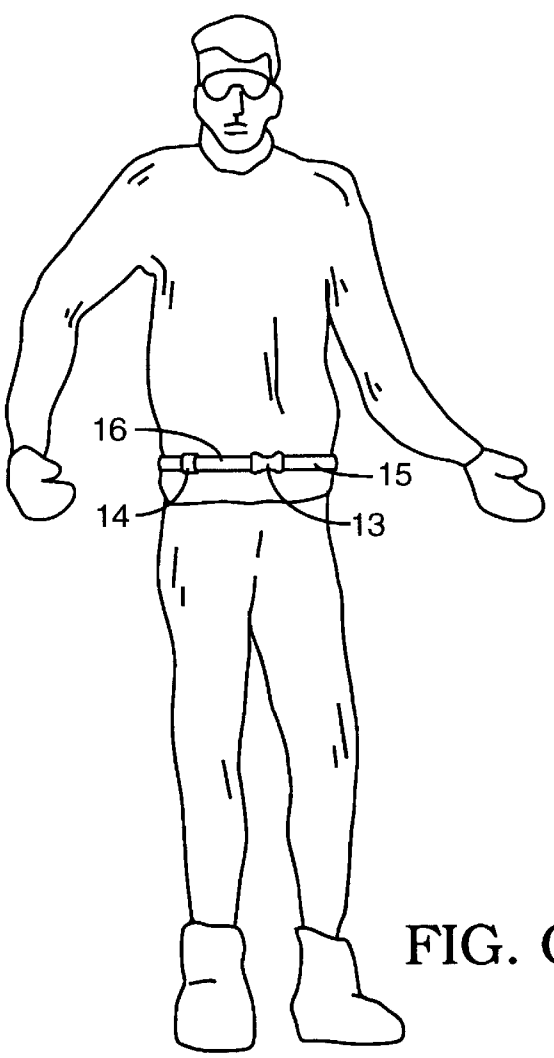
FIG. C3
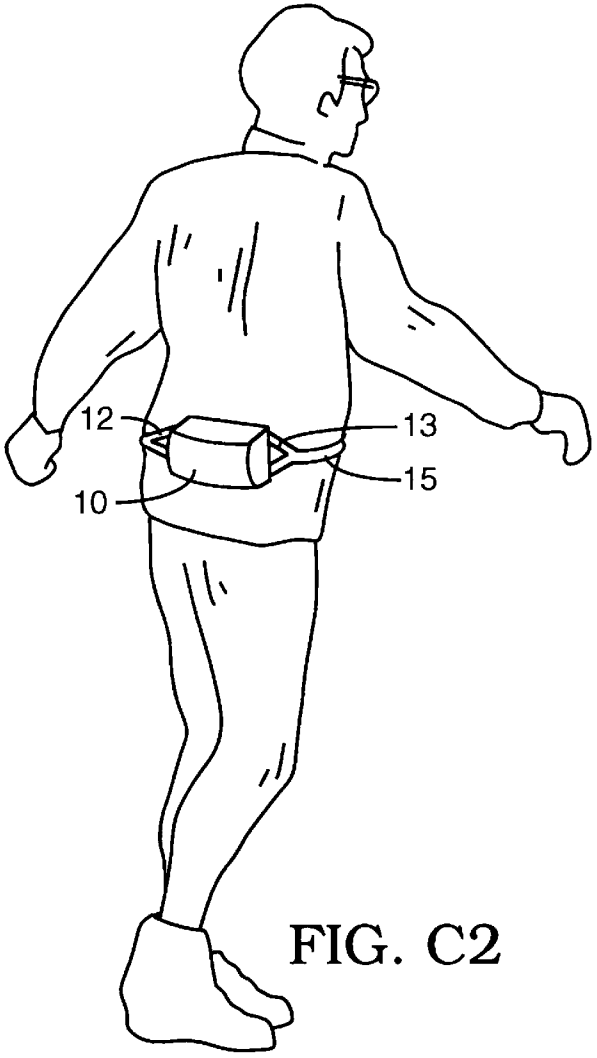
FIG. C2

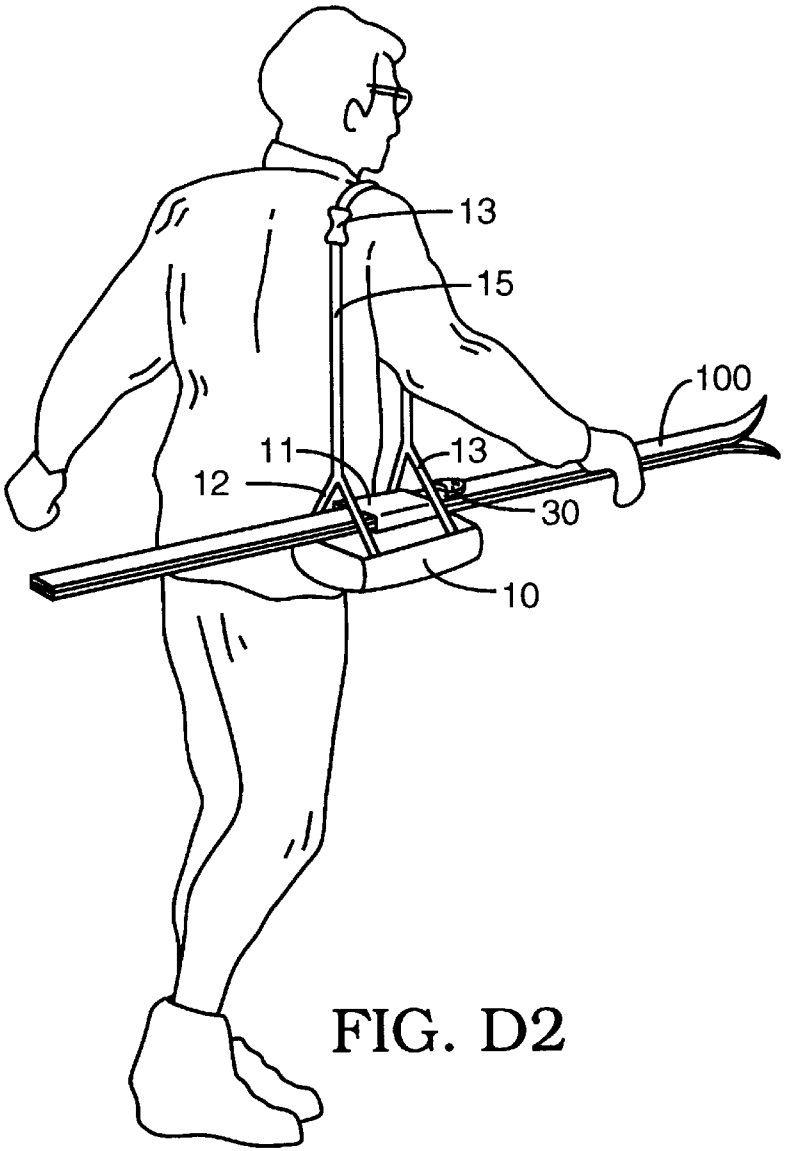
FIG. D2
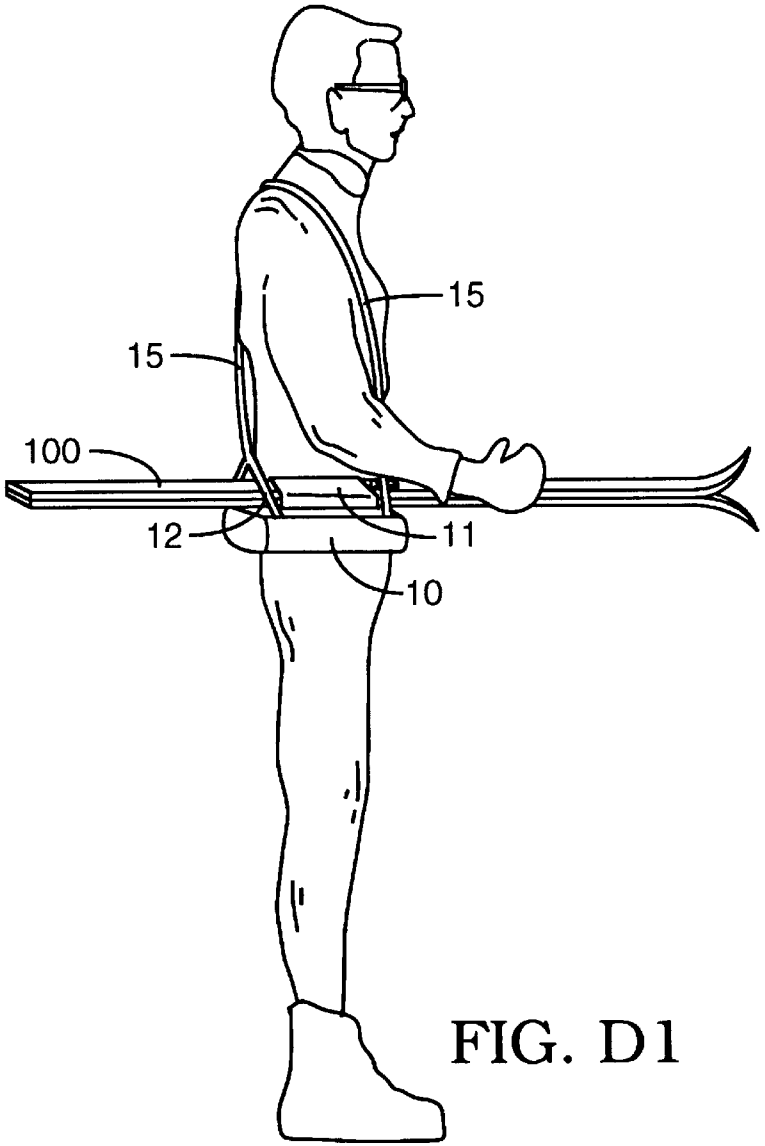
FIG. D1

SKI EQUIPMENT CARRIER

FIELD OF THE INVENTION

The present invention relates to a device for carrying equipment, such as snow skis and related equipment, that is capable of being converted into a fanny-pack or an equipment belt.

BACKGROUND OF THE INVENTION

One of the difficulties faced by a skier is the transportation of the ski equipment to the ski area. Although the ski equipment is generally not heavy, its size and shape make it cumbersome to carry and awkward to maneuver. For example, a skier may need to carry a pair of skies, ski poles, and ski boots, as well as goggles, gloves, sun glasses, a snack or a drink, and the like from the parking lot or the lodge to the ski area. As the popularity of skiing increases, the walk becomes longer, and is particularly inconvenient for individuals less able to carry the needed equipment.

Apparatus that aid in the transport of the ski equipment to and from the recreation area are known. In general, the device consists of a harness for the ski equipment and a handle or shoulder strap attached to the harness that assists with the lifting and carrying of the equipment. The ski equipment is usually fastened to the harness with straps that are permanently affixed and often rigid. This design of the ski equipment carrier possesses several drawbacks. For example, the interface between the harness and the straps is subject to increased wear and premature failure; the straps often twist and distort rendering them useless for the intended purpose; the fastening means are often complex or difficult to engage, especially in cold weather; the device does not always securely hold the equipment thereby causing damage such as scratching and denting of the ski surface; and the device is inconvenient to employ as it is necessary to rest it on the ground while the skier fastens the harness straps, providing an opportunity for dirt, moisture and other foreign material to damage the equipment.

Thus, there is a need for a convenient and practical ski equipment carrier that is portable and compact. In addition, it is desirable that such a carrier be durable, easy to use, and hold the ski equipment securely in place thereby protecting the equipment from unnecessary damage. Finally, there is a need for a device that can additionally carry ancillary gear, equipment and supplies for the ski enthusiast.

SUMMARY OF INVENTION

The present invention provides a device for carrying equipment, such as a pair of snow skis and other ski equipment. The device comprises a container where the top can be at least partially detached in a manner so as to open the container, a means for holding the skis attached to the outside surface of the container, a first carrying belt attached to a first point of the container, and a second carrying belt attached to a second point of the container. The device can be deployed in a sling-like fashion to conveniently transport the skis. In addition, other supplies can be transported within the container, or secured to the outside of the container.

Accordingly, the invention provides a device that is simple, practical, and can be used to carry equipment such as skis, and alternatively, can be used as an equipment storage unit. The device can carry from one to several pair of snow skis, and can be attached to the skis set in a vertical or a horizontal position.

In addition, the device of the invention provides for a container that holds various items for the ski enthusiast, wherein the items do not have to be removed when the device is converted into a ski carrying system.

Furthermore, the device of the invention is constructed from a soft, flexible material, and is designed such that it does not provide hindrance to skiing. The device of the invention can be manufactured in child and adult sizes.

BRIEF DESCRIPTION OF THE DRAWINGS

FIG. A1 is a perspective view of the device of the invention for holding skis;

FIG. A2 is a perspective view the device shown in FIG. A1 showing the ski holding means of the device on top;

FIG. B1 is an overhead plan view of the device of the invention showing the ski holding means in a closed position;

FIG. B2 is an overhead plan view of the device showing the ski holding means in an open position;

FIG. B3 shows a side view of the device including the carrying belts;

FIG. B4 shows another embodiment of the device which includes a means for holding a water bottle with water bottle in place;

FIG. B5 shows an end view of the device with the skis in place;

FIG. B6 shows an end view of the device without skis in place;

FIG. C2 shows the device in place on a user without skis;

FIG. C3 shows a front view of the user with the device in place;

FIG. D1 shows a side view of the device in place on a user with the skis being held; and FIG. D2 shows a side perspective view of the device on a user with the skis in place.

In the figures the reference numbers refer to components as shown below:

10 container or equipment storage compartment
11 ski holding means
11 Velcro™ wrap
12 "V" belt
13 plastic buckle
14 plastic adjustment slide
15 waist and shoulder strap
16 waist and shoulder strap
17 box & cross stitch
18 zipper
19 box & cross stitch
20 Velcro™ strips
20 Velcro™ material
21 Velcro™ strips
21 zipper handle
23 elastic straps
25 plastic eyelets
27 large box & cross stitch
28 water bottle
30 ski bindings
100 skis

DETAILED DESCRIPTION OF PREFERRED EMBODIMENTS

Before the present ski equipment carrier is described, it is to be understood that this invention is not limited to particular configurations and material described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. Velcro™ is described in U.S. Pat. Nos. 2,717,437, 3,000,084, and 3,009,235, each incorporated herein by reference to disclose and describe Velcro™. All publications mentioned herein are incorporated herein by reference to disclose and describe the methods and/or materials in connection with which the publications are cited.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

Referring now the to drawings, FIG. A1 shows a preferred embodiment of the device with skis (100) in place. The device is comprised of a container (10). The container (10) may be in any configuration but is preferably in the form of a container with a rectangular shaped bottom with four walls extending upward from the bottom to a detachable top which is connected via a zipper (18) which may be opened by pulling the zipper tab (19).

FIG. A1 shows the equipment storage compartment (10) with zipper (18) and zipper handle (21) in the closed position. The Velcro™ wrap (11) is attached around the skis (100), approximately around the ski bindings (30). The waist and shoulder strap (15) is shown in a fully extended position ready to be used as a shoulder strap or sling. The waist and shoulder strap (15) is preferably constructed from Nylon strapping material and is approximately 1 inch in width and about 40 inches in length, however the dimensions can vary to accommodate an adult or a child. On the waist and shoulder strap (15) is a detachable buckle (13) and a adjustment slide (14). The buckle and the adjustment slide are made from plastic, metal, or ceramics, but preferably plastic. Another buckle (13) is located on the "V" belt (12) that is attached to the equipment storage compartment (10). A box and cross stitch (19) is shown connecting the "V" belt (12) to the waist and shoulder strap (15).

As shown in FIG. A2, the container (10) is attached to a ski holding means (11). The ski holding means (11) may be any means for securely holding the skis (100) to the outside surface of the container (10). However, the ski holding means (11) is preferably in the form of a flexible material which is securely attached to a side of the container (10). In addition to the ski holding means (11), the first carrying belt (15) and second carrying belt (15) are both attached to the same side of the container (10). The belts (15) may be attached at any point on the container. However, it is preferable that the belts each have an end portion which forms a V-shaped end (12) so that the end can be connected to the side of the container at two places. In an alternative embodiment, the Velcro™ wrap (11) can form a side of the container (10).

In the FIG. A2 perspective view, the Velcro™ wrap (11) is attached to the snow skis (100) near the ski bindings (30). In addition, the box and cross stitch (19) is shown for attaching the plastic buckle (13) to the Nylon waist and shoulder strap (15), and for attaching the "V" ends (12) of the waist and shoulder strap (15) to the side of the container (10).

As shown in FIG. B1, each belt (15) preferably includes a detachable buckle (13) as well as an adjustment slide (14) which can be used to adjust the length of the belt (15). In the back view of the ski equipment carrier of FIG. B1, the Velcro™ wrap (11) is in a closed position without skis (100). The "V" belts (12) and the plastic buckle (13) are shown in an extended perspective to show the box and cross stitch (17) attaching the "V" belts (12) to the waist and shoulder strap (15) and to the equipment storage compartment (10).

As best shown in FIG. B2, the ski holding means or Velcro™ wrap (11) is most preferably connected to an entire side of the container (10) with attachment means such as sewing taking place along the outer edges of the side of the container (10) and crossing over the entire surface of the side of container (10) as so that the ski holding means (11) is held securely in place. In FIG. B2 the material is designed so as to include pressure-engageable fastening fabric strips such as Velcro™ strips (20) and (21) which attach securely to each other. Other types of attachment means which are readily connectable and detachable from each other could be used. FIG. B2 is a back view of the ski equipment carrier with the Velcro™ wrap (11) in the open position, with the skis not yet attached, where the box and cross stitch (17) is used to attach the Velcro™ material (20) to the Velcro™ wrap (11). Also shown is a large box and cross stitch (27) used to attach the Velcro™ wrap (11) to the equipment storage compartment (10). The plastic buckle (13) on the "V" belt (12) is shown in a closed or buckled position.

FIG. B3 shows the front view of the equipment storage compartment (10) where the detachable top is closed via the zipper (18). In addition, a section of the carrying belt (15) with the adjustment slide (14) and the detachable buckle (13) is shown. Also in FIG. B3 is a section of the waist and shoulder strap (15) showing the plastic buckle (13) in the closed position and the plastic adjustment slide (14). Between the plastic buckle (13) and plastic adjustment slide (14) is the adjustment portion of the waist and shoulder strap (16).

FIG. B4 shows the preferred embodiment of the device with a water bottle (28) held in place by the securing means (23). The securing means (23) are preferably in the form of elastic straps that are attached to a side of the container (10) that is other than the side having the means for holding skis (11). The bottom view of the container (10) in FIG. B4 shows the plastic eyelets (25) that allow the ends of the elastic straps (23) to pass through a wall of the equipment storage compartment (10). Also shown is the Velcro™ wrap (11) in the close position and the "V" belts (12) in a pulled or stretched position.

A side section of the device is shown in FIG. B5 with the skis (100) held against the side of the container (10) by ski holding means (11) attached securely to each other by Velcro™ strips (20). FIG. B6 shows the side section of the device without the skis.

The preferred embodiment of the device in place on a user with or without skis is shown in FIG. C2 and FIG. D1. When the device is not being used for carrying skies, as shown in FIG. C2, the device can be used as a fanny-belt that is attached around the waist by means of the carrying belt (15). As better shown in FIG. C3, the carrying belt (15) is adjusted to comfortably fit the user by means of the adjustment slide (14) and the two ends of the carrying belt are connected with the detachable buckle (13).

As shown in FIG. D1, the device can be quickly converted into a ski carrying device. Typically, the pair of skis are positioned such that their bottom surfaces are in contact with each other. On the upper surface of one of the skis, typically resting around the ski bindings area, the device is placed such that the ski holding means (11) can be engaged with the skis securely held in between the V-shaped ends (12) of the belt (15). The belt is then lengthened to the desired length by adjusting the adjustment slide (14) and placed over the skier's shoulder. Thus, as shown in FIG. D1 and FIG. D2, the skis can be conveniently transported by means of the device in a sling-like fashion. In addition, the storage compartment (10) can hold items such as goggles, gloves, snacks, or drinks, and the elastic straps can additionally secure a water bottle or the like to the side of the storage compartment (10).

FIG. D2 is the back view of a person using the ski equipment carrier to carry or transport skis. It shows the Velcro™ wrap (11) wrapped around the skis (100). The waist and shoulder strap (15), attached to the container (10) via the "V" belts (12) and adjusted to a comfortable length, is positioned over the shoulder of the person for transporting the equipment.

Other accessories may be attached to the equipment storage compartment (10) such as, but not limited to, clips, tying devices for attaching gear, and a pocket capable of holding small items, such as currency. The device can be made of various material, such as nylon, rayon, leather, Cordura Plus, and the like, where the material is variously colored. A device of the invention intented for children can be extremely brightly colored. In addition, the device having various dimensions may be manufactured. Accordingly, the device of the invention is simple yet practical, flexible, and reliable to use.

The function and the operation of the equipment carrier is straightforward. The equipment carrier has two functions. First as shown in FIG. C2 and FIG. C3 it can be used as a fanny-pack or belt equipment storage carrier. In FIG. C2 the equipment storage compartment (10) is shown attached to a person's waist by means of the waist and shoulder strap (15). The length of the waist and shoulder strap (15) is adjusted by sliding the plastic adjustment slide (14) to the proper position and then connecting the plastic buckle (13) in the front as shown in FIG. C3.

The second function of the equipment carrier is that it quickly converts into a transporting device as shown in FIG. D1 and FIG. D2. The device is removed from the person's waist and with the snow skis in a bottom touching position as shown in FIG. A1 and FIG. D2, the "V" belt (12), is placed over either end of the skis (100) and slid down to about the middle of the skis. With the equipment storage compartment (10) resting between the ski bindings (30), the Velcro™ wrap (11) is wrapped around the skis (100) and secured snugly as in FIG. A2. The plastic buckle (13) on the "V" belt (12) is opened, the "V" belt (12) placed around the skis (100), and the plastic buckle (13) is the closed, as in FIG. A2. The adjustment portion of the waist and shoulder strap (16), is the lengthen to the desired length (see FIG. A2). The plastic buckle (13) on the waist and shoulder strap (15) is connected, allowing the skis to be carried or transported in a sling like fashion as in FIG. D1 and FIG. D2.

While the present invention has been described with reference to specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

We claim:

1. A device for carrying equipment, comprising:

a container comprised of a bottom, walls connected to the bottom and a top connected to a wall such that the top can be at least partially detached in a manner so as to open the container;

a means for holding skis attached to an outside surface of the container;

said means comprises a rectangular flexible material having a first end, a second end, and a mid-portion wherein the first and second ends of the material are detachably connectable to each other via pressure-engageable fastening fabric strips;

a first carrying belt having a first end configured in V-shape with two components each having a free end with each of the two component free ends respectively attached on opposite sides of the container; and a second carrying belt having a first end configured as a V-shaped two component end with each of the two components attached on opposite sides of the container.

2. The device of claim 1, wherein the means for holding skis is comprised of flexible material attached to the outside surface of the container, the material extending beyond a first outside surface edge of the container at a first end of the material and beyond a second outside surface edge of the container at a second end of the material, wherein the first and second ends of the material are detachably connectable to each other.

3. The device of claim 1, wherein the bottom and top of the container are substantially rectangular.

4. The device of claim 2, wherein at least two sides of the container are substantially rectangular.

5. The device of claim 4, wherein the flexible material is attached to a substantial portion of one of the substantially rectangular sides.

6. The device of claim 1, wherein a second end of the first carrying belt is attached to a first connecting means and a second end of the second carrying belt is attached to a second connecting means which is detachably connectable to the first connecting means.

7. The device of claim 6, wherein the first belt comprises a means for adjusting belt length.

8. The device of claim 2, wherein the first and second ends of the material are detachable connectable to each other via pressure-engageable fastening fabric strips.

9. The device of claim 1, wherein the top is detachably connected to the walls of the container via a zipper.

10. A device for carrying equipment, comprising:

a first means for holding equipment that comprises a rectangular flexible material having a first end, a second end, and a mid-portion, wherein the first and second ends of the material are detachably connectable to each other via pressure-engageable fastening fabric strips;

a substantially rectangular container that comprises a detachable top, a bottom, and at least three walls connecting the top and the bottom, wherein the container is attached to the mid-portion of the flexible material; and a means for carrying the device attached to the container comprising a first carrying belt having two ends wherein a first end is attached to the outside surface of a wall, and a second carrying belt having two ends wherein a first end is attached to the opposite end of the wall, wherein the first end of the first carrying belt and the first end of the second carrying belt are a V-shape with two components each having free ends with one component end attached to the wall near the top of the container and the other component end attached to the wall near the bottom of the container.

11. The device of claim 10, wherein the mid-portion of the flexible material comprises one of the walls of the container.

12. The device of claim 10, wherein the first V-shaped component end of the first carrying belt is detachably attached to the wall of the container.

13. The device of claim 10, wherein the first carrying belt comprises a means for adjusting the belt length.

14. The device of claim 10, wherein a second end of the first carrying belt is detachably connected to a second end of the second carrying belt.

15. The device of claim 10, further comprising a second means for holding equipment attached to the outside surface of the container.

16. The device of claim 15, wherein the second means comprises elastic straps.

17. The device of claim 15, wherein the outside surface having the second means for holding equipment is other than the outside surface having the first means.

18. A container comprised of a bottom, walls connected to the bottom forming a rear wall, a front wall and sidewalls, and a top hingedly connected to the rear wall such that the top is at least partially detached in a manner to open the container;

a means for holding skis attached to the outside surface of said rear wall;

a first carrying belt having a first end configured in a V-shape with two components each having a free end, with each of the two components free ends respectively attached to said rear wall on opposite sides of said means for holding skis;

a second carrying belt having a first end configured in a V-shape with two components each having a free end, with each of the two components free ends respectively attached to said rear wall on opposite sides of said means for holding skis and spaced from the attachment of said first belt to said rear wall.

* * * * *